US006029734A

United States Patent [19]

Wang et al.

[11] Patent Number: 6,029,734

[45] Date of Patent: Feb. 29, 2000

[54] VENETIAN BLIND PROVIDED WITH SLAT-LIFTING MECHANISM HAVING A CONCEALED PULL CORD

[75] Inventors: Wei-Cheng Wang, Tai Nan Hsien; Ray-Ten Chen, Hsin Chu; Ya-Wei Hsu, Hsin Chu, all of Taiwan

[73] Assignees: Industrial Technology Research Institute, Hsinchu; Nien Made Enterprise Co., Ltd., Chang Hua Hsien, both of Taiwan

[21] Appl. No.: 09/224,360

[22] Filed: Jan. 4, 1999

[51] Int. Cl.[7] ..... E06B 9/322

[52] U.S. Cl. ..... 160/170 R

[58] Field of Search ..... 160/170 R, 171 R, 160/168.1 R, 168.1 P, 191, 192, 193, 84.06

[56] References Cited

U.S. PATENT DOCUMENTS 2,276,716 3/1942 Cardona ..... 160/170 R
5,170,830 12/1992 Coslett ..... 160/192 X
5,482,100 1/1996 Kuhar ..... 160/192 X
5,531,257 7/1996 Kuhar ..... 160/168.1 P

*Primary Examiner*—David M. Purol
*Attorney, Agent, or Firm*—Browdy and Neimark

[57] ABSTRACT

A slat-lifting mechanism of the Venetian blind is composed of a slat set, a pull set, a slat pull cord, and a locating set. The slat set has a plurality of slats. The pull set has a pull cord member and a spring retrieving unit which is linked with the pull cord member. The slat pull cord has one end that is put through the slat set, and other end that is fastened with the pull set. The locating set is disposed in the traveling path of the slat pull cord and is capable of bringing about a friction resistance which is greater than a retrievable pull force of the spring retrieving unit for overcoming the pulling force of the slat pull cord, so as to control the pulling or the releasing of the slat pull cord. The slat set can be thus located by the locating set.

7 Claims, 3 Drawing Sheets

VENETIAN BLIND PROVIDED WITH SLAT-LIFTING MECHANISM HAVING A CONCEALED PULL CORD

FIELD OF THE INVENTION

The present invention relates generally to a Venetian blind, and more particularly to a slat-lifting mechanism of the Venetian blind. The slat-lifting mechanism has a pull cord that is concealed to eliminate the potential safety hazard of the exposed pull cords of the prior art slat-lifting mechanism of the Venetian blind.

BACKGROUND OF THE INVENTION

The conventional Venetian blind consists of a slat-lifting mechanism having an outer pull cord, a slat set pull cord and a ratchet member. The outer pull cord is so exposed as to facilitate the pulling of the outer pull cord by hand. The slat set pull cord is connected with the slat set and linked with the outer pull cord for controlling the ascending and the descending of the slat set. In the meantime, the ratchet member is driven by the slat set pull cord to remain in an engaging state or a disengaging state, so as to locate the slat set at a desired position.

The exposed outer pull cord of the slat-lifting mechanism of the prior art is a potential safety hazard in view of the fact that a playful child may be accidentally strangled by the exposed outer pull cord. In addition, the exposed outer pull cord is prone to becoming entangled with the slat set.

SUMMARY OF THE INVENTION

It is therefore the primary objective of the present invention to provide the Venetian blind with a slat-lifting mechanism having a concealed pull cord for eliminating the safety hazard.

It is another objective of the present invention to provide the Venetian blind with a slat-lifting mechanism which is simple in construction and is provided with an excellent esthetic effect.

In keeping with the principle of the present invention, the foregoing objectives of the present invention are attained by the slat-lifting mechanism consisting of a slat set, a pull set, a slat pull cord, and a locating set. The slat set has a plurality of slats. The pull set has a pull cord member and a spring retrieving unit which is linked with the pull cord member. The slat pull cord has one end that is put through the slat set, and other end that is fastened with the pull set. The locating set is disposed in the moving path of the slat pull cord and is capable of bringing about a friction resistance greater than a retrieving force of the spring retrieving unit for overcoming the pulling force of the slat pull cord, so as to regulate the pulling or the releasing of the slat pull cord. The slat set can be thus located by the locating set.

The foregoing objectives, features, and functions of the present invention will be more readily understood upon a thoughtful deliberation of the following detailed description of the present invention with reference to the accompanying drawings.

DETAILED DESCRIPTION OF THE INVENTION

Figure 1:
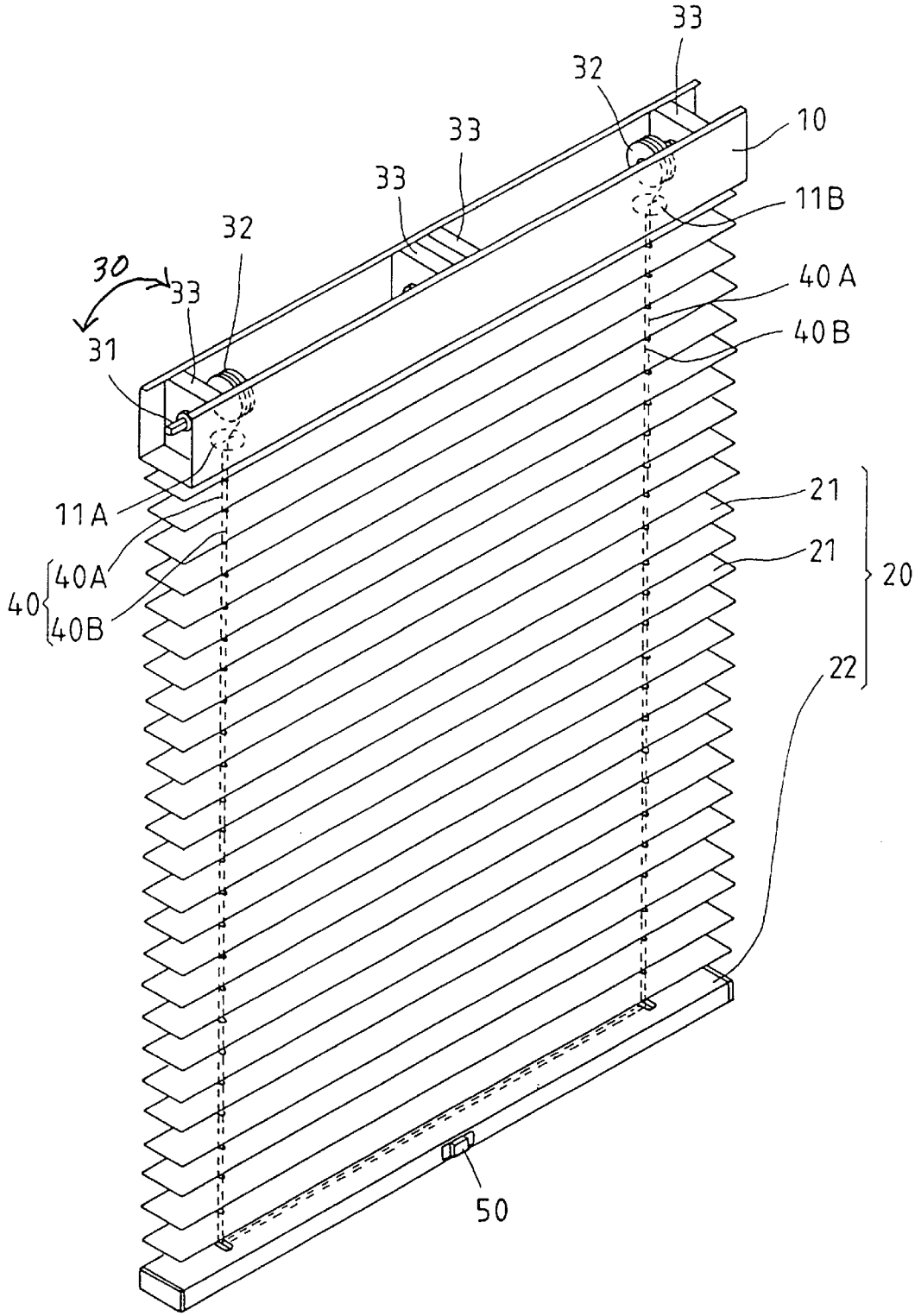
FIG. 1 shows a perspective view of the present invention.

As shown in FIG. 1, a slat-lifting mechanism of a Venetian blind embodied in the present invention is composed of a frame 10, a slat set 20, a pull set 30 a slat pull cord 40, and a locating set 50.

The frame 10 is located at the top of the Venetian blind for fastening the Venetian blind with a window. The frame 10 is provided at the bottom thereof with two fastening portions 11A and 11B, which are located at both ends of the bottom of the frame 10.

The slat set 20 is made up of a plurality of slats 21 and provided at the bottommost portion thereof with a bottom plate 22. The total weight of the slat set 20 is denoted by W.

Figure 2:
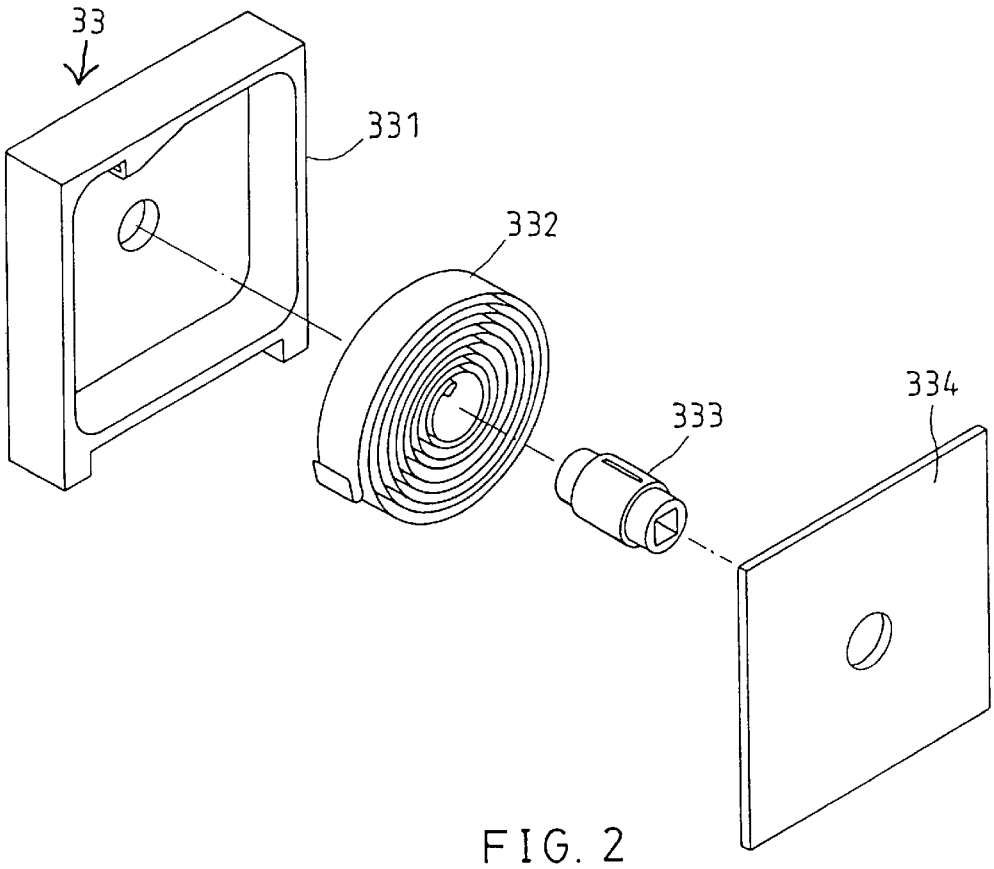
FIG. 2 shows an exploded view of a pulling unit of the present invention.

The pull set 30 is disposed in the frame 10 and provided with a spindle 31 having a polygonal cross section. The spindle 31 is respectively provided at both ends thereof with a pull cord member 32, which is a winding wheel. The pull set 30 has at least one spring retrieving unit 33, as shown in FIG. 2. The unit 33 has a seat 331 which is provided in the interior thereof with a volute spring 332. The outer end of the volute spring 332 is fastened with the seat 331, whereas the inner end of the volute spring 332 is provided with a sleeve shaft 333 having a hollow cross section which corresponds to the cross section of the spindle 31 and is engageable with the spindle 31. A cover 334 is joined with the outer end of the seat 331 such that the seat 331, the volute spring 332, the sleeve shaft 333, and the cover 334 form together a modular spring retrieving unit 33. The volute spring 332 is provided with a retrievable pull force (denoted by R) at the time when the volute spring 332 is installed. The retrievable pull force (R) must be greater than the total weight (W) of the slat set 20 in order to enable the slat set to be pulled up in its entirety. This can be also expressed as follows:

$$R(\text{retrievable pull force}) > W(\text{total weight of slat set})$$

The slat pull cord 40 has two pull cords 40A and 40B, which are fastened respectively at one end thereof with the pull cord member 32 such that other end thereof is drawn downward through each slat 21, the bottom plate 22, and upward through each slat 21 to fasten with the fastening portion 11A(11B)of the frame 10.

Figure 3:
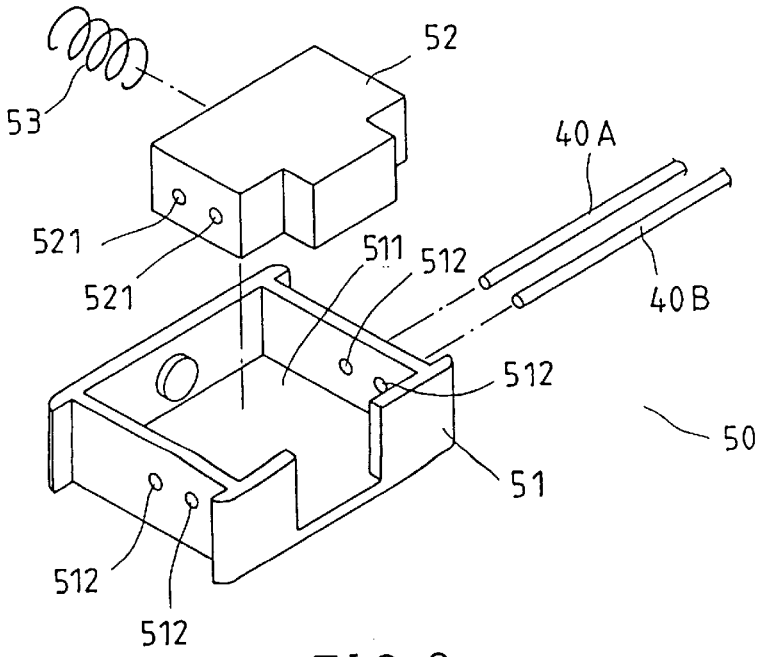
FIG. 3 shows an exploded view of a locating unit of the present invention.
Figure 4:
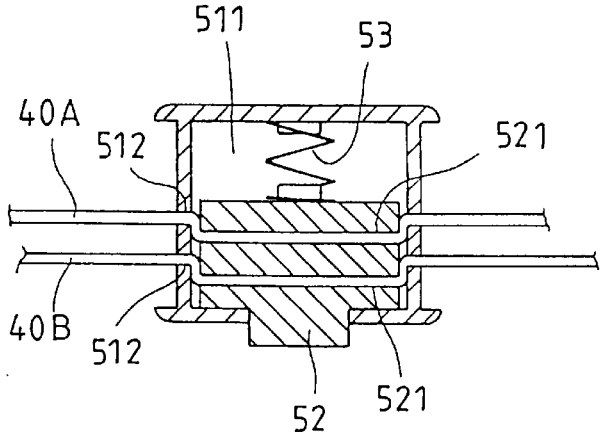
FIG. 4 shows a schematic view of the locating state between the locating set and each pull cord of the present invention.

The locating set 50 is located at the middle of the bottom plate 22 of the slat set 20, as shown in FIG. 3. The locating set 50 has a case 51 which is provided with a receiving space 511 covered by a cap 54. The case 51 is provided with two cord holes 512 parallel to each other. A retaining member 52 is located in the receiving space 511 of the case 51 such that the bottom of the retaining member 52 is urged by a spring 53. The retaining member 52 is provided with two cord holes 521 parallel to each other. The two pull cords 40A and 40B of the slat pull cord 40 are received in the cord holes 512 of the case 51 and the cord holes 521 of the retaining member 52. As shown in FIG. 4, when the retaining member 52 is naturally urged by the spring 53, the cord holes 521 of the retaining member 52 and the cord holes 512 of the case 51 are located alternately to bring about the clamping effect that acts on the pull cords. By means of the clamping force and the friction resistance (denoted by F) of the locating set 50, the rewinding force of the pull cords 40A and 40B is overcome by the difference between the retrievable pull force (R) and the total weight of the slat set (W). this can be expressed as follows:

$$R-W<F$$

Figure 5:
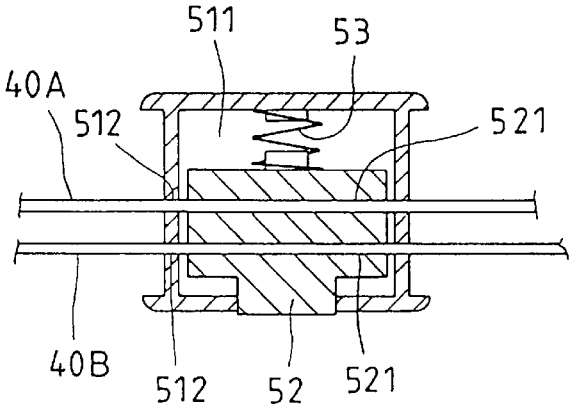
FIG. 5 shows a schematic view of the releasing state between the locating set and each pull cord of the present invention.

As a result, the slats can be located at any position of the ascending course or the descending course of the slats. Now referring to FIG. 5, when the retaining member 52 is exerted on by an external force, the cord holes 521 of the retaining member 52 and the cord holes 512 of the case 51 are almost corresponding in location to one another. In the meantime, the clamping force and the friction force acting on the pull cords 40A and 40B by the locating set 50 are minimal. As a result, the pull cords 40A and 40B are in the state of being released. When the slats are pushed upwards by hand, the rewinding force of the pull cords 40A and 40B is greater than the clamping force and the friction resistance, thereby causing the slats to ascend. On the contrary, if the clamping force and the friction resistance are made smaller or diminished by pressing the retaining member 52 with hand, the slats can be descended with a little pull force in view of the fact that a greater part of the upward rewinding force of the pull cords 40A and 40B is cancelled out by the weight of the slat set. The slats can be located at any position by releasing the retaining member 52 from hand.

Figure 6:
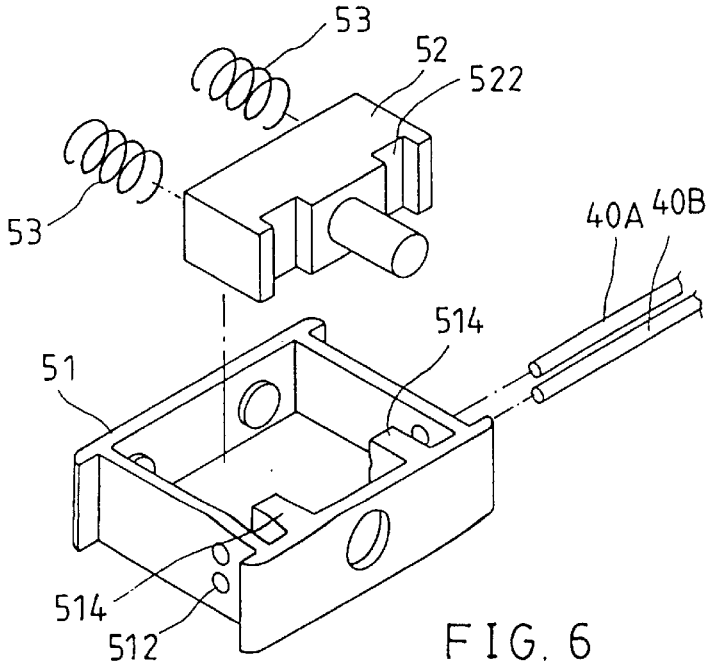
FIG. 6 shows a sectional view of a locating set of another preferred embodiment of the present invention.

As shown in FIG. 6, another preferred embodiment of the present invention has a locating set 50 different in construction from that of the first preferred embodiment described above. The case 51 of the locating set 50 is provided with two cord holes 513 parallel to each other, whereas the receiving space 51 of the case 51 is provided at the top thereof with two shoulders 514. The retaining member 52 is provided at the top thereof with two recesses 522 corresponding in location to the two shoulders 514. The retaining member 52 is urged by the spring 53 such that the two shoulders 514 are retained in the two recesses 522 of the retaining member 52, and that the clamping force and the friction resistance are brought about. If the urging force of the spring 53 is overcome with hand, the pull cords 40*a* and 40B can be released.

The structure of the locating set 50 is not confined to that which was described above. The locating set 50 may be provided with a stepped tenon-mortise structure to bring about the clamping force and the friction resistance to act on the pull cords. The pull cords may be arranged unidirectionally from the slat set bottom to the pull set, instead of the loop-type arrangement of the embodiments described above. However, the retaining member 50 must be disposed on the traveling paths of the pull cords 40*a* and 40B. The Venetian blinds have slats which may be various in number and weight in accordance with the size of the window. This problem can be dealt with by the modular spring unit 33 which can be adjusted in number easily and rapidly. Moreover, the inner end of the volute spring 332 of the present invention may be directly fastened with the spindle 31, without the use of the sleeve shaft 333. The present invention are therefore limited only by the scopes of the following appended claims.

What is claimed is:

1. A slat-lifting mechanism for a venetian blind having a top frame and a bottom plate and a plurality of slats arranged therebetween with pull cords extending from said bottom plate to said top frame through said plurality of slats, said slat-lifting mechanism comprising:

pull sets each having a pull cord member rotatably engaged to a spring actuated retrieving unit;

a locating set having a retaining member;

a first end of each of said pull cords adapted to be engaged to said pull cord member and a second end of each of said pull cords adapted to be fixed to said venetian blind;

said locating set adapted to be fixed to said bottom plate between said first end and said second end of each of said pull cords as said pull cords extend through said locating set;

said retaining member adapted to clamp said pull cords extending through said locating set when said retaining member is at rest;

wherein pulling down said plurality of slats with said retaining member at rest set each said spring actuated retrieving unit for respectively winding each of said pull cords around said pull cord member;

wherein a retrieving force of said spring actuated retrieving unit when set is greater than a weight of said plurality of slats and said bottom plate; and wherein, when said retaining member is actuated to disengage clamping of said pull cords and said bottom plate is pushed up against said weight, said plurality of slats ascends.

2. The mechanism as defined in claim 1, wherein said pull cord member is a winding wheel mounted on a spindle; and wherein said spring retrieving unit has a volute spring which is fastened at an inner end thereof with said spindle, said volute spring further fastened at an outer end thereof with a seat.

3. The mechanism as defined in claim 1, wherein said pull cord member is a winding wheel mounted on a spindle; and wherein said spring retrieving unit has a volute spring which is fastened at an inner end thereof with a sleeve shaft which is in turn joined with said spindle, said volute spring further fastened at an outer end thereof with a seat.

4. The mechanism as defined in claim 1, wherein said locating set has a case provided with a receiving space and a plurality of cord holes, the retaining member disposed in said receiving space of said case such that the retaining member is urged by a spring, the retaining member provided with a plurality of cord holes; and wherein said slat set pull cords are received in said cord holes of said case and said cord holes of the retaining member.

5. The mechanism as defined in claim 1, wherein said locating set is of a stepped tenon-mortise construction.

6. The mechanism as defined in claim 1, wherein said locating set is disposed in the middle of said bottom plate of said slat set.

7. The mechanism as defined in claim 3, wherein said volute spring and said sleeve shaft of said spring retrieving unit are disposed in a seat which is covered with a cap; and wherein said volute spring, said sleeve shaft, said seat, and said cap form together a modular structure.

* * * * *